United States Patent [19]

Klingaman et al.

[11] 4,201,300

[45] May 6, 1980

[54] CAPSULE PACKAGE

[75] Inventors: Richard J. Klingaman, Darien, Conn.; Arthur V. Boyce, Jr., New York, N.Y.

[73] Assignee: Colgate-Palmolive Company, New York, N.Y.

[21] Appl. No.: 922,089

[22] Filed: Jul. 5, 1978

Related U.S. Application Data

[63] Continuation of Ser. No. 734,903, Oct. 22, 1976, abandoned.

[51] Int. Cl.[2] ..... B65D 5/50

[52] U.S. Cl. ..... 206/45.19; 206/45.31; 206/303; 206/395; 206/397; 206/416; 206/822

[58] Field of Search ..... 206/45.14, 45.19, 395, 206/396, 397, 407, 415, 416, 476, 482, 587, 588, 589, 590, 45.31, 303, 392, 222, 634, 822; 222/541; D7/27; 229/87 R, 87 T

[56] References Cited

U.S. PATENT DOCUMENTS

| | | | |
|---|---|---|---|
| D. 58,248 | 6/1921 | Meeker | D7/27 |
| 2,101,282 | 12/1937 | Piper | 206/395 |
| 2,631,724 | 3/1953 | Wright | 206/392 |
| 2,708,066 | 5/1955 | Caraher | 206/392 X |
| 2,908,437 | 10/1959 | Wiedenmeier | 206/591 |
| 3,276,616 | 10/1966 | Lurie | 220/276 |
| 3,338,399 | 8/1967 | Burt | 206/395 |
| 3,737,028 | 6/1973 | Carlson | 206/416 X |
| 3,807,622 | 4/1974 | Belcher et al. | 206/587 X |
| 3,819,847 | 6/1974 | Charles | 206/303 X |
| 3,853,741 | 12/1974 | Klupt | 206/45.31 |

FOREIGN PATENT DOCUMENTS

| | | | |
|---|---|---|---|
| 1028671 | 5/1953 | France | 206/415 |
| 1197531 | 6/1959 | France | 206/392 |

*Primary Examiner*—Joseph Man-Fu Moy

*Attorney, Agent, or Firm*—Le Blanc, Nolan, Shur & Nies

[57] ABSTRACT

A liquid detergent capsule is packaged in an open-ended carton formed from a single elongate strip having transverse fold regions, the top and bottom walls of the carton being formed with wells confining the top and bottom of the capsule and there being coaxial central posts projecting centrally in the wells into adjacent recesses in the capsule.

7 Claims, 12 Drawing Figures

FIG. 6
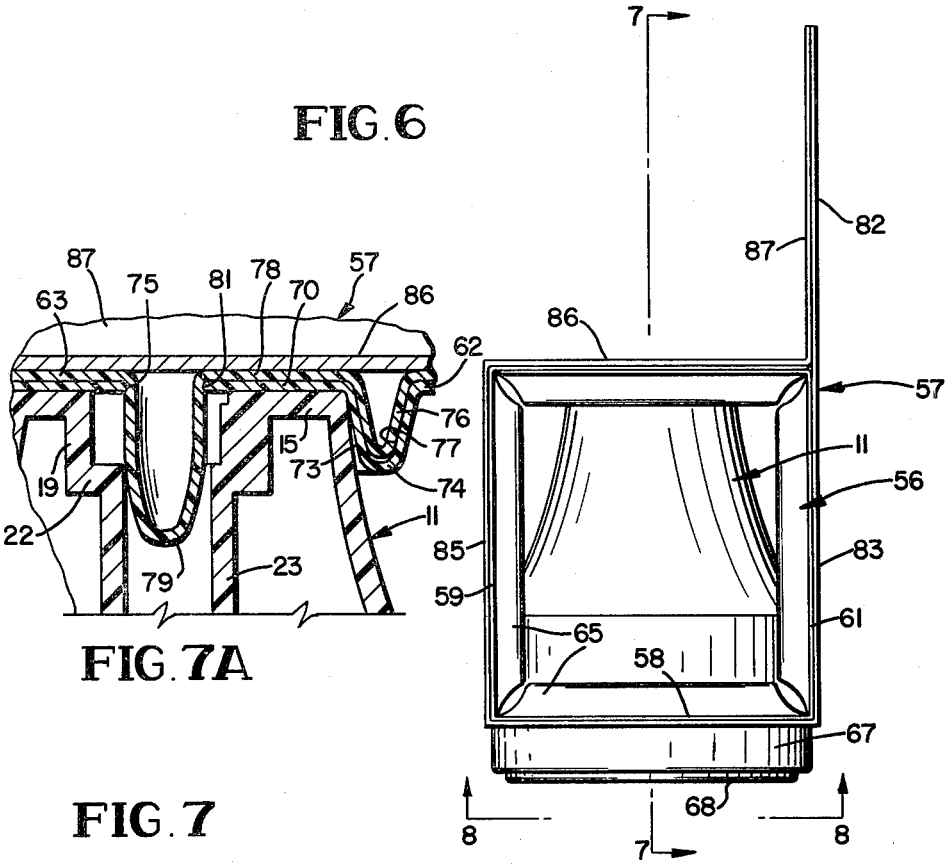
FIG. 7A
FIG. 7
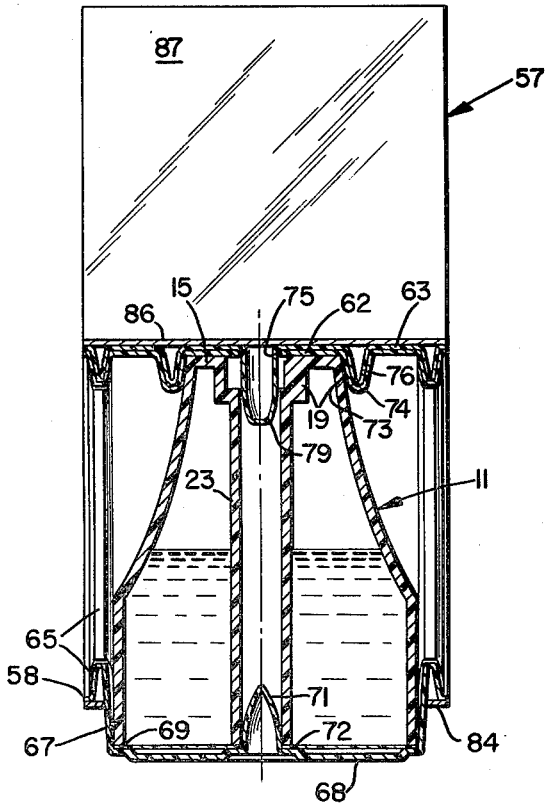
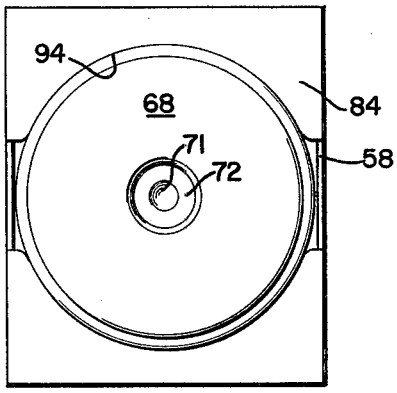
FIG. 8

CAPSULE PACKAGE

This is a continuation of application Ser. No. 734,903, filed Oct. 22, 1976, now abandoned.

This invention relates to packaging and particularly to the packaging of containers in open-ended cartons that permit inspection of the container while preventing unauthorized or accidental withdrawal of the container from the carton.

In its preferred embodiments the invention will be described for packaging a container in an open-ended carton that has top and bottom wall formations specially interfitting with the container to prevent unauthorized or accidental removal of the container through the open carton ends. The invention is of particular utility in the packaging of possibly dangerous fluids such as capsules of detergent liquid concentrate adapted to be used for refills in mixer-dispenser units. For example the packaging is practically child proof since the carton must be disrupted to remove the container.

It is therefore a major feature of the invention to provide novel packaging for containers such as liquid detergent concentrate capsules wherein the container is mounted in a carton of simple construction that permits inspection of the container through open ends but secures the container therwithin so as to prevent unauthorized or accidental removal.

Another major feature of invention is a novel carton structure for container packaging wherein opposite, preferably top and bottom, walls of the carton are formed with wells and aligned projections seating and coacting with corresponding opposite (top and bottom) walls of the container.

Pursuant to the foregoing a more specific feature for mounting a container having coaxial top and bottom recesses, which may be the ends of a through central wall, in novel carton structure wherein opposed posts extend through the wells into the recesses.

A further novel feature is the provision of an open-ended carton made from an elongated blank of relatively stiff material such as thin plastic having parallel transverse fold of hinge areas at the junctures of the carton side, top and bottom walls and preformed wells and projections on the sides of the top and bottom walls that are to be inwardly facing in the package.

Further advantageous novel features will appear as the description proceeds in connection with the appended claims and the annexed drawings.

BRIEF DESCRIPTION OF DRAWINGS

FIG. 6 is a side elevation of a package according to a further embodiment;

FIG. 7 is a section substantially in line 7—7 of FIG. 6 showing detail;

FIG. 7A is an enlarged fragmentary view in section showing the snap fit of the upper carton wall members;

FIG. 8 is a bottom plan view of the package carton;

PREFERRED EMBODIMENTS

Figure 1:
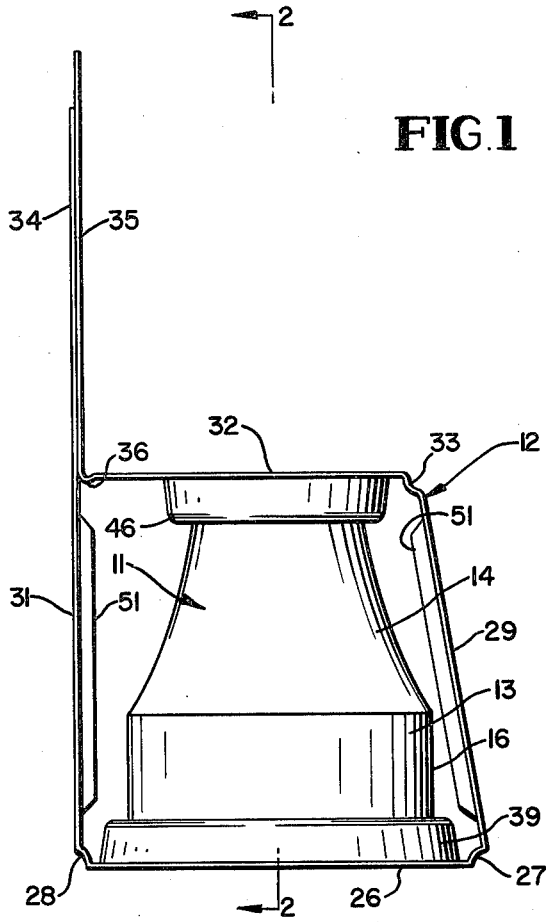
FIG. 1 is a side elevation of a package according to a preferred embodiment of the invention.

FIG. 1 shows the package as consisting essentially of a concentrate container or capsule 11 mounted in an open-ended carton 12.

Figure 2:
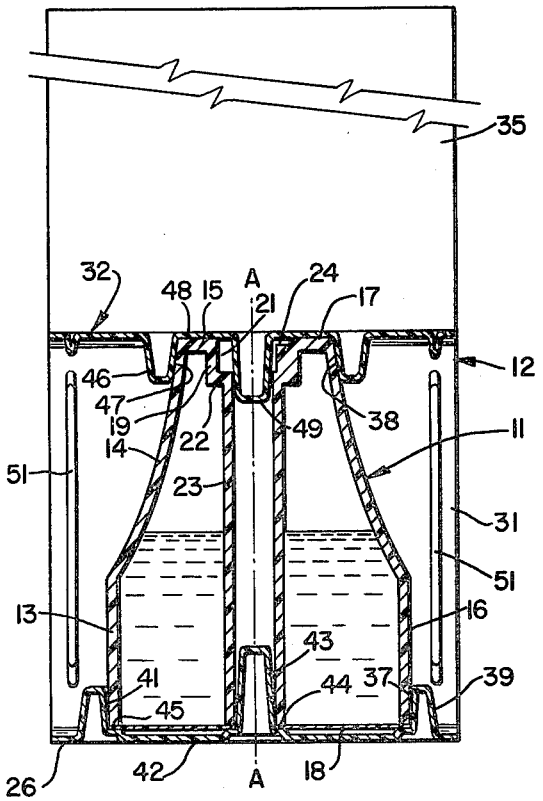
FIG. 2 is a section substantially on line 2—2 of FIG. 1.

As shown in FIGS. 1 and 2, capsule 11 is symmetrical about a vertical axis A—A and has a lower cylindrical section 13 and an upper section 14 that decreasingly tapers to a top wall 15. Lower section 13 has a smooth outer cylindrical surface 16, and top wall 15 has an annular flat outer surface 17 lying in a plane perpendicular to the axis A—A.

The lower end of capsule 11 is closed by a frangible annular bottom wall 18 that is preferably a sheet of relatively thin synthetic plastic bonded peripherally around the lower edges of cylindrical section 13. Wall 18 is planar and parallel to the flat planar top wall surface 17 and perpendicular to the central vertical axis of the capsule. The capsule walls at 13, 14 and 15 are stiff and relatively resistant to collapse, and may be integrally bonded synthetic plastic elements. Wall 18 on the other hand is readily punctured as by projections in a dispenser.

The capsule side wall at 13, 14 is considerably thicker and materially more rigid than the deliberately frangible bottom wall 18. Preferably the capsule side wall is an integral stiff plastic annulus of polyethylene or the like that is longitudinally non-deformable and substantially non-deformable laterally and is also hard enough to be considerably resistant to puncturing even by a sharp point. The capsule is capable of retaining its original shape under all operative conditions including the condition wherein it may be contacted by a rotating closure cap in a dispenser and forced toward projections that may rupture the bottom wall. The bottom wall 18 is preferably a flexible sheet of substantially film thickness polyethylene or the like so as to be readily punctured and torn but strong enough not to sag appreciably due to the weight of the contents of the capsule.

A shallow well is centrally formed in capsule top wall 15 and it comprises a cylindrical collar 19 depending from a central circular opening 21 in wall 15 and an internal annular ledge 22. A small uniform diameter tube 23 extends vertically from an open upper end at ledge 22 down through the center of the capsule to terminate in sealed contact with the inner periphery of bottom wall 18, leaving the bottom of tube 23 open. Collar 19 and tube 23 are preferably of the same stiff plastic as the side walls and may be integral therewith.

Within the well a plurality of three rigid radial projections 24 are provided, preferably extending the depth of the well but not above wall 15. The inner ends of these projections lie in a circular envelope having a diameter at least as large as the internal diameter of tube 23.

The foregoing capsule structure provides a capsule that is uniform about the indicated vertical centerline, and it encloses an annular chamber which is filled with the concentrated detergent that is to be combined with water or other liquid in the body of a mixer-dispenser container when the capsule is mounted in assembly with that container. Such assembly is disclosed in the pending application of Richard J. Klingaman Ser. No. 665,758 filed Mar. 11, 1976, now U.S. Pat. No. 4,088,246 issued May 9, 1978, and reference is made thereto for any further detail necessary to understand the structure and use of the capsule.

Figure 3:
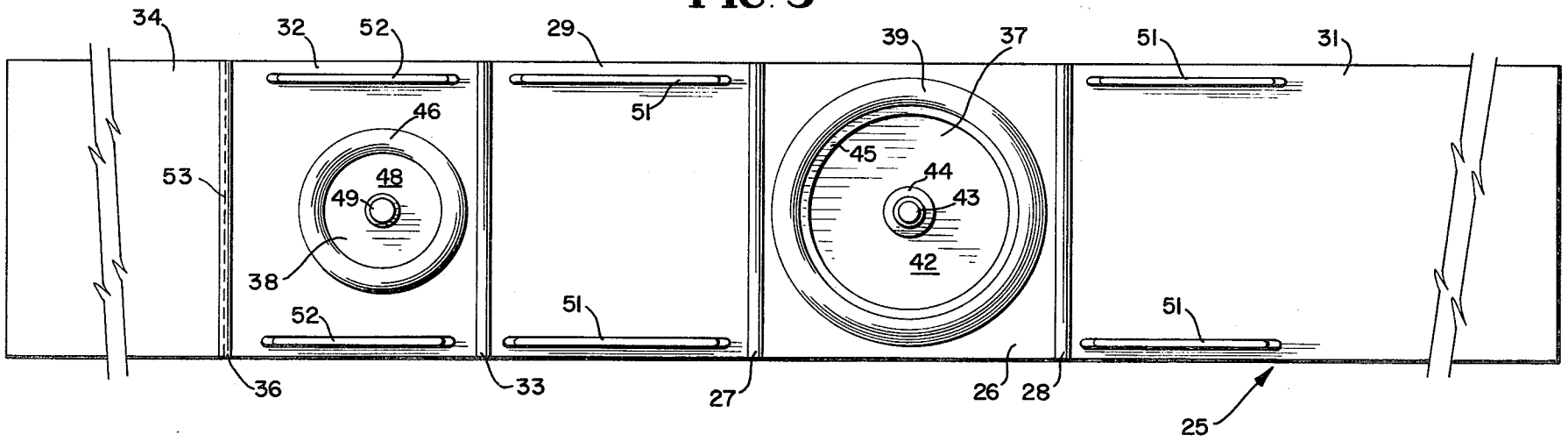
FIG. 3 is a plan view showing the inner side of the formed carton blank prior to wrapping it about the capsule.
Figure 4:
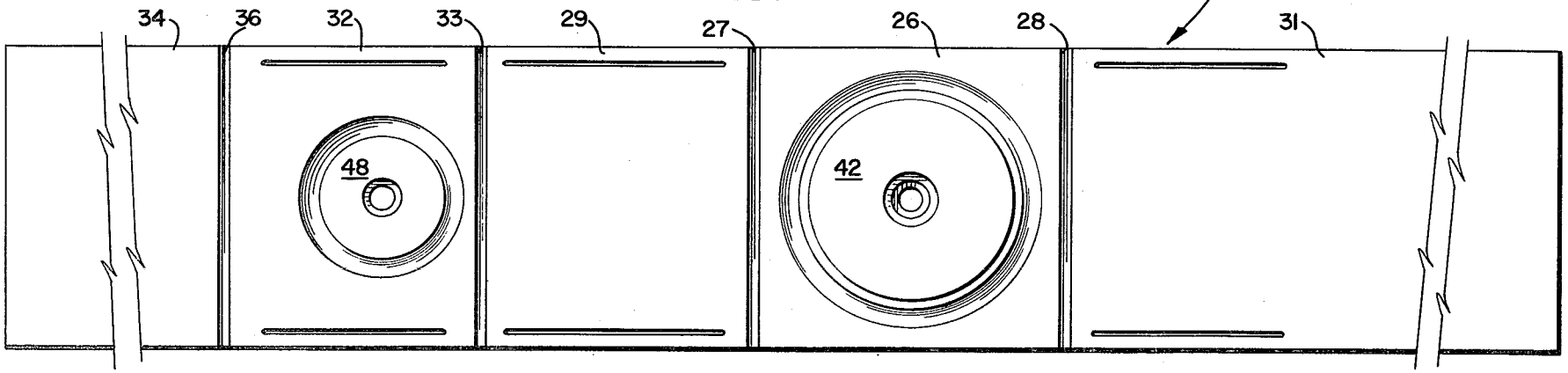
FIG. 4 is a plan view showing the outer side of the formed carton blank of FIG. 3.

The carton for capsule 11 consists of the preformed generally rectangular blank 25 shown in FIGS. 3 and 4, having transverse hinge or fold areas whereby it may be essentially wrapped around the capsule to the condition illustrated in FIG. 1.

Referring to FIG. 1, the carton comprises a bottom wall 26 connected by hinge areas 27 and 28 to front and rear upright side walls 29 and 31 respectively and a top wall 32 generally parallel to bottom wall 26 connected by hinge area 33 to side wall 29. Rear side wall 31 may have a vertically extending panel 34 above the level of top wall 32 in backing relation to a vertical display panel 35 connected by hinge area 36 to top wall 32. Panels 34 and 35 are preferably permanently surface bonded together in the assembly, to hold the package together and also to prevent unauthorized opening of the package to extract the capsule as will appear.

In the package the capsule bottom and top seat within fairly snugly fitting coaxial lower and upper shallow wells 37 and 38 respectively as shown in FIG. 2. The lower well 37 is formed by an upstanding integral generally annular hollow rim 39 the inner surface 41 of which is of slightly greater diameter than cylindrical surface 16 of the capsule, so that the capsule may be snugly slidably inserted into the well from above. The inner well surface 41 may be cylindrical or slightly frusto-conical as shown for ease of entry of the capsule.

As shown in FIG. 2, well 37 has a flat annular bottom 42 having centrally a central hollow post 43 projecting vertically upwardly on the axis A—A in the assembly. Post 43 is of about the same diameter as the interior of tube 23 so as to extend snugly thereto. Post 43 may be cylindrical or slightly frusto-conical as shown for ease of entry into tube 23. Concentric with post 43, the bottom of well 37 is formed with coplanar concentric narrow upwardly facing flat annular ledges 44 and 45. These ledges it will be seen in FIG. 2 are spaced a small distance above well bottom 42 and adapted to seat the inner and outer peripheries of the essentially annular capsule so as to provide an annular air space or cushion between the frangible bottom wall 18 of the capsule and the well bottom 42. Thus the capsule wall 18 is protectively spaced above the carton wall in the package.

The vertical height of post 43 is also greater than the vertical height of rim 39, so that once a capsule is seated in well 37 is it effectively restrained against both lateral movement and tilting.

The upper well 38 is similarly formed by a downwardly extending integral annular hollow rim 46 the inner surface 47 of which is sized to snugly receive the top of capsule 11, being preferably of slightly greater diameter than the capsule top wall 15. Well 38 has a flat annular bottom 48 adapted to seat firmly and flat on top surface 17 of the capsule.

Centrally of well 38 is an integral depending hollow post 49 that in the package extends coaxially of post 43 snugly into the upper end of tube 23. Post 49 may be cylindrical or slightly frusto-conical as shown to facilitate entry and fitting with the capsule. Post 49 is of greater height than rim 46 whereby in the assembly both wells and the associated posts cooperate to resist lateral movement and tilting of the capsule.

The carton is preferably formed from an elongated blank of relatively stiff plastic material thermo-preformed to provide the wells, post and transverse hinge or fold areas above described. Preferably also the blank is formed with a plurality of side wall ribs 51 and top wall ribs 52 for preventing buckling of those walls during formation of the package and in handling and storage.

In making the package, the blank is preformed, the filled capsule is seated in well 37 with post 43 inserted in tube 23, the side walls 28 and 29 are bent up about hinge areas 27 and 28, the top wall is bent over at hinge area 33 to lie flat on the top of the capsule and insert post 49 into the top of tube 23 and panel 35 turned up around hinge area 36 to lie in flat surface engagement with panel 34, to which it is adhesively or thermally bonded.

The resultant package is self-sustaining in that the stiff carton side walls and the longitudinally stiff capsule contribute mutually to resist deformation under pressure, and the concentrate capsule which may have caustic or other injurious contents is securely locked within the package while being clearly visible through the open ends. When the capsule is to be used, the package must be effectively destroyed, as by tearing on a score line 53 along the hinge area 36.

Figure 5:
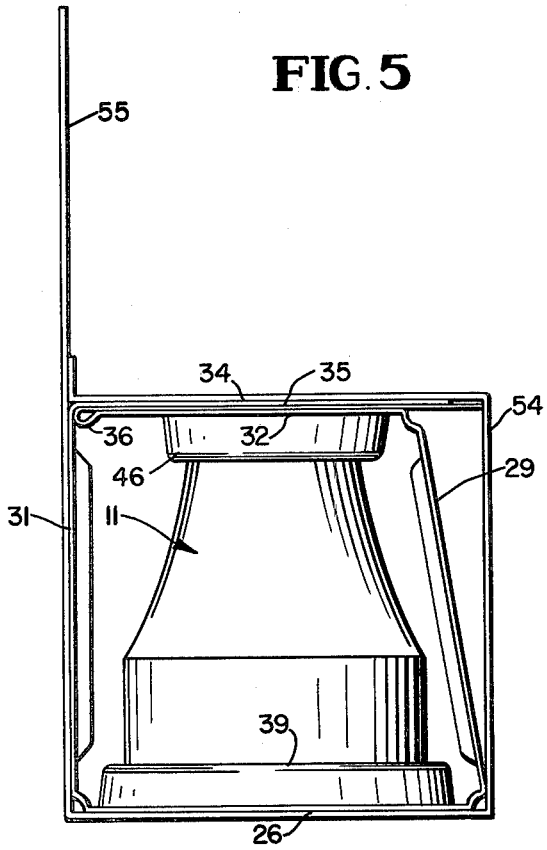
FIG. 5 is a side elevation showing a modified package.

FIG. 5 illustrates a modification wherein the panel 35 is bent over at right angles to lie flush upon and to be bonded to the outer side of top wall 32, the panel 34 may be omitted or bent over to overlie panel 35 to which it is bonded. The package assembly further includes a rectangular sleeve 54 slipped endwise thereover to extend over top, side and bottom carton walls while leaving the ends open. This sleeve may be a rectangular blank folded to shape about the carton and includes a vertical extension panel 55 which like panel 35 in FIG. 1 may be printed with a trademark, directions and other material.

Referring now to FIGS. 6–11, the package, similarly to FIG. 5, comprises an open ended carton indicated at 56 and a surrounding sleeve indicated at 57.

Carton 56 presents a generally cubical appearance and comprises a bottom wall 58, opposite side walls 59 and 61, and a top wall structure consisting of an inner wall 62 and an overlapped outer wall 63. These walls are joined by transverse parallel hinge areas 64 (FIGS. 9, 10) enabling a preformed blank to be folded to the condition of FIG. 6.

Figure 9:
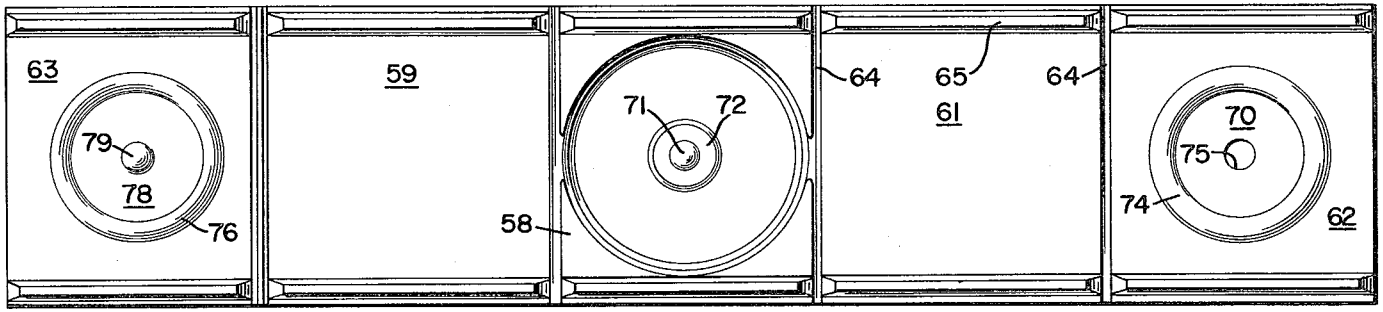
FIG. 9 is a plan view showing the inner side of the carton blank prior to folding it about the capsule.
Figure 10:
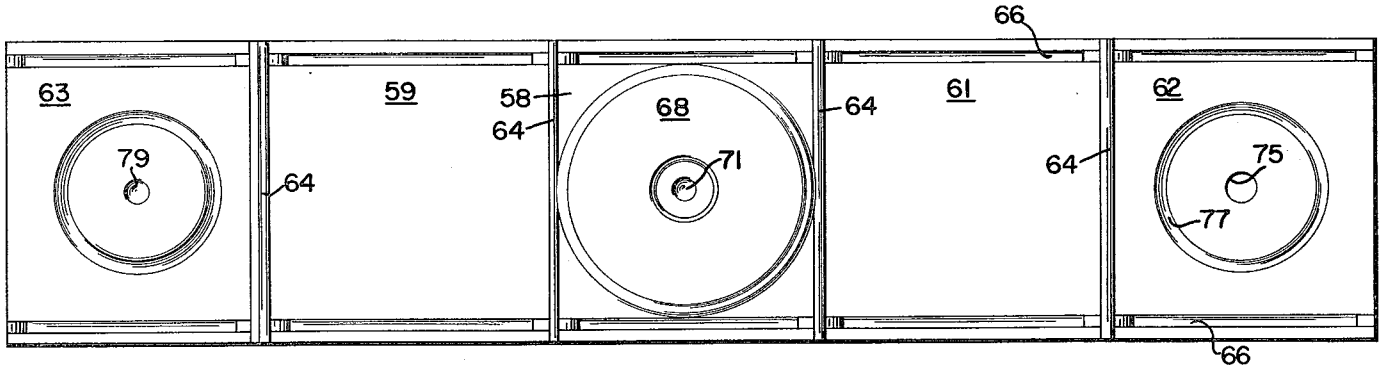
FIG. 10 is a plan view showing the outer side of the carton.

As shown in FIGS. 9 and 10 the walls are all formed with parallel internal ribs 65 that in the assembly extend the length of each wall at opposite ends of the carton, except for interruptions at the hinged areas 64, and since the blank is molded from a sheet of stiff plastic, formation of the ribs 65 results in formation of corresponding parallel recesses 66 facing externally of the carton.

Bottom wall 58 is formed with a shallow depending cylindrical well 67 having a flat bottom 68 parallel to wall 58. The well bottom is formed around its outer periphery with an annular ledge 69 joining the bottom to the cylindrical side of the well, and this ledge is spaced a small distance above bottom 68 for the same purposes as ledge 45 in FIG. 2.

Upstanding from the center of well bottom 68 is an integral hollow generally conical post 71 surrounded at its base by an annular ledge 72 of the same height as ledge 69 and for the same purpose as ledge 44 in FIG. 2.

The parallel side walls 59 and 61 are preferably solid and blank in the carton.

In the composite top wall structure, the inner wall 62 is formed with an upper well 73 defined partly by an internally projecting circular hollow rim 74 similar to rim 46 of FIG. 2. The bottom of well 73 is the annular central part 70 of wall 62 and is provided with a circular aperture 75. The outer wall 63 is similarly formed with a depending circular hollow rim 76 sized and concentrically located in the carton to fit (FIG. 7A) snugly in the outwardly facing recess 77 externally defined by rim 74, and the bottom 78 of the well structure defined by rim 76 is the annular central portion 78 of wall 63. A hollow generally conical post 79 extends integrally from outer well portion part 78, and in the folded carton assembly post 79 has a snap fit into aperture 75. An annular locking recess 81 (FIG. 7A) may be provided at the base of post 79 so that post 79 which may be slightly oversize with respect to aperture 75 may have a snap lock fit with the fully inserted post, and this retains the folded carton 56 in assembled position on the capsule.

In the carton the ribs 65 of outer top wall 63 nest snugly into recesses 66 of the inner top wall 62 (FIG. 7) and rim 76 nests into recess 77, and coplanar walls 62 and 63 are otherwise flat and in full surface contact. Adhesive may be provided between walls 62 and 63.

In the package as shown in FIG. 7 the capsule 11 is seated on its bottom within well 67 with post 71 extending with friction fit up into the lower end of tube 23. The smaller diameter upper end of capsule 11 extends snugly into well 73 with the flat well bottom 70 flush with the top wall 15 of the capsule and aperture 75 in coaxial alignment with the upper end of tube 23. When outer wall 63 is folded over it lies flush on wall 62 with post 79 projecting through aperture 75 into frictional fit in the upper end of tube 23. As hereinbefore noted post 79 may have locking engagement with the aperture 75 for holding the carton in folded assembly on the capsule.

As in the earlier embodiment, the fragile bottom wall of the capsule is protectively spaced by ledges 69 and 72 above the bottom of well 67.

Figure 11:
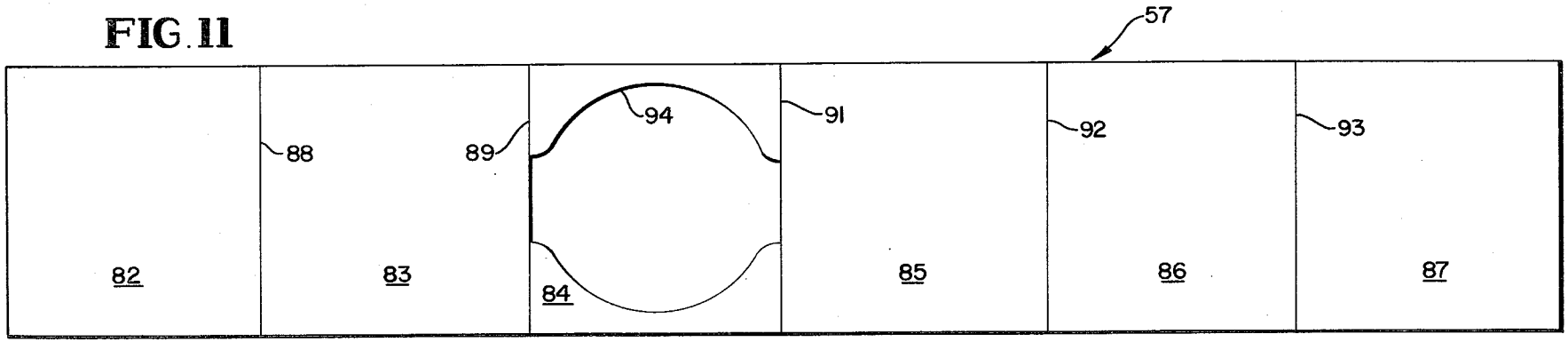
FIG. 11 is a plan view of the casing blank prior to wrapping it about the folded carton blank.

The blank for sleeve 57 is shown in FIG. 11. It comprises a rectangular cardboard sheet having consecutive panels 82–87 joined by parallel transverse hinge or fold regions 88–93. Panel 84 is formed with a central aperture 94 sized to fit slidably over bottom well 67 so that in the package panel 84 will lie flush with bottom wall 58 of the carton. Panels 83 and 85 are folded upwardly to lie flush with carton side walls 59 and 61, and panel 86 is folded to overlie upper top wall 63. End panel 87 is folded to extend vertically flush with the other end panel 82, and the two end panels are adhesively secured together as shown in FIG. 6, thus securing the folded blank in sleeve forming position and holding it on the erected carton 56. As in the earlier embodiments the upright panels of the sleeve may bear advertising or the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

The embodiment of the invention in which an exclusive property or privilege is claimed is defined as follows:

1. A package comprising a sealed closed liquid filled container having axially aligned top and bottom tubular recesses, and a surrounding open-ended carton having top and bottom walls integrally formed with annular ribs projecting toward each other from the inner surfaces of said top and bottom walls and defining aligned opposed internally open wells extending peripherally around and receiving and confining the top and bottom respectively of said container, said wells containing integral coaxial posts surrounded by said ribs and projecting toward each other internally of the carton and of such size as to snugly enter said top and bottom recesses in the confined container, and said carton being formed from a single elongated strip of relatively stiff sheet material having a succession of carton wall sections joined by transverse hinge regions.

2. The package defined in claim 1, wherein one of said wells comprises a depressed region of said bottom wall.

3. The package defined in claim 1, wherein each of said posts is of greater height than the associated annular rib.

4. The package defined in claim 1, wherein the upper one of said wells is defined by overlapping wall members one of which is formed with an opening extending over the associated container recess and the other of which contains the upper one of said posts which extends with a snap fit through said opening into the associated recess.

5. A package consisting essentially of an upright relatively stiff side wall sealed closed liquid containing capsule mounted in an open-ended carton, said capsule having parallel flat external top and bottom surfaces and a central through inner tubular wall open at top and bottom through said surfaces, and said carton being formed from a single sheet of relatively stiff material having a succession of wall sections joined by transverse hinge regions and providing substantially parallel top and bottom walls integrally formed with annular hollow ribs defining oppositely facing internally open wells snugly receiving and peripherally externally confining the top and bottom respectively of said capsule, there being internally projecting integral central posts within said wells extending with snug fit into the opposite ends of said tubular wall.

6. The package defined in claim 5, wherein said capsule bottom wall is a frangible sheet and the bottom of the well in the carton bottom wall is shouldered at its outer periphery whereby the capsule is supported in said bottom wall with said frangible sheet spaced from said carton bottom wall within the well.

7. The package defined in claim 5, wherein said top wall comprises overlapping wall panels having a snap fit interconnection through the associated port for holding the carton erected.

* * * * *